US008465056B2

(12) United States Patent
Weir et al.

(10) Patent No.: US 8,465,056 B2
(45) Date of Patent: Jun. 18, 2013

(54) LONGBOARD SKATING PROPULSION POLE FOR LAND PADDLING

(76) Inventors: Robert Weir, Miami, FL (US); Nicholas Fredella, Miami, FL (US)

( * ) Notice: Subject to any disclaimer, the term of this patent is extended or adjusted under 35 U.S.C. 154(b) by 262 days.

(21) Appl. No.: 12/960,786

(22) Filed: Dec. 6, 2010

(65) Prior Publication Data

US 2012/0139224 A1 Jun. 7, 2012

(51) Int. Cl.

| | |
|---|---|
| ***A63C 11/22*** | (2006.01) |
| ***A63C 11/00*** | (2006.01) |
| ***A45B 7/00*** | (2006.01) |

(52) U.S. Cl.

USPC ..... 280/819; 280/809; 280/820; 280/823; 135/65

(58) Field of Classification Search

USPC ..... 280/809, 821, 816, 78, 47.3, 47.32, 280/11.2, 819, 826, 822–823; 135/82, 65, 135/75, 72, 85

See application file for complete search history.

(56) References Cited

U.S. PATENT DOCUMENTS

| | | | | |
|---|---|---|---|---|
| 5,687,991 | A * | 11/1997 | Gairdner | 280/826 |
| 6,330,888 | B1 * | 12/2001 | Aravantinos et al. | 135/66 |
| 7,520,513 | B1 * | 4/2009 | Bush | 280/35 |
| 7,699,368 | B2 * | 4/2010 | Nicol | 294/26 |

* cited by examiner

*Primary Examiner* — John Walters
*Assistant Examiner* — James Triggs
(74) *Attorney, Agent, or Firm* — Allen, Dyer, Doppelt, Milbrath & Gilchrist, P.A.

(57) ABSTRACT

The invention is directed to a telescoping pole to help direct a longboard comprising a first and second portion. The first portion includes a first end, a second end and a first tubular shaft. A first handle is positioned at the first end, while a second handle is positioned along the first tubular shaft between the first and second end. The second portion also has first end, a second end, and a second tubular shaft (having a diameter less than the first tubular shaft). The first end of the second portion is attached to the first portion through a first coiled spring. A wheel assembly having a spinning wheel is affixed to the second end of the second portion having a third tubular shaft having diameter less than the second tubular shaft. A second coiled spring is placed over the third tubular shaft, which engages the second portion.

4 Claims, 6 Drawing Sheets

LONGBOARD SKATING PROPULSION POLE FOR LAND PADDLING

FIELD OF THE INVENTION

This invention is directed toward a telescoping pole used to propel a user when engaging in longboard skating. More specifically, the invention is directed to a telescoping pole having a first portion, a second portion, and a wheel assembly having a spinning wheel which rotates perpendicular to both the first and second portions.

BACKGROUND OF THE INVENTION

A longboard is a form of skateboard akin to a surfboard with wheels. Longboards are commonly used for cruising, or alternatively may be used for downhill or slalom on a gradient. Longboards can be shaped in various ways, depending on the type of riding for which the board is intended. Their greater weight and bulk makes them less suitable for many skateboarding tricks, and instead most users focus on creating fluid motions. This is why longboarding is often compared to surfing on concrete, as a longboard's design allows for big turns or short carves similar to that of a snowboard.

The shape and construction of a longboard is similar to a traditional skateboard. Most longboarders wear gloves and a protective helmet. Often, longboarders also don wrist, groin, elbow and knee protection. Most longboards measure between 90 and 150 cm (35.4-60 inches). Shorter boards may still be referred to as longboards when their main purpose is in line with that of longboarding. There are several different shapes of longboards, including pintails, flat nose riders, and boards shaped like a longer shortboard. Pintails permit looser trucks and larger diameter wheels better suited for carving or a "surfy" feel. Mid-length boards, 94-127 cm (37-50 inches) are the most versatile.

Unlike conventional skateboards, longboards are commercially available in a great array of shapes and sizes. Each type of deck has certain advantages and disadvantages, and there are many boards that fall in between the several most prominent categories. There are a few main shapes of board. A popular shape is the Pintail which is a teardrop-shape deck, typically flat and suitable for beginners. The pintail shape is used to prevent wheelbite while still providing ample foot space.

Another type is Drop-through decks, where the middle of the deck is lower than where the trucks are mounted. This can be achieved by either a "drop through" cutout, where the trucks are mounted through the deck, or a "dropped" deck where the deck is pressed in such a way that the truck mounts are placed higher than the standing platform. A lowered platform allows for greater stability at high speeds and easier pushing, as the other leg must bend less. However, this deck type is not always well-suited for very loose trucks which allows for a great deal of lean, leading to a condition called "railbite" where the rails of the deck scrape the ground. Speed bumps can create a hazard, where the dropped platform impacts the speedbump, stopping the deck.

Hybrid longboards include wheel cutouts which provide room for the wheels to turn at sharper angles while avoiding wheelbite. Another quality of hybrid boards is that they are around 30-40 inches in length, which allows creativity for the rider to complete the same tricks as on a skateboard. A downside of all hybrid longboards is the possibility for "shoebite" which happens due to the cutout in the deck so the shoe will rub on the wheel slowing or stopping the rider. Another classic deck shape is the Cruiser shape. These have a somewhat similar shape to normal skateboards, in that they have a kicktail on the back.

Decks intended for riding downhill are typically stiff and have a wheelbase of around 30". There are three primary shapes for these decks: topmount, dropthrough, and dropmount. These different decks have different ride heights, which affects the cornering ability. Footspace is important on a downhill deck, so the board can facilitate a user's aerodynamic "tuck". Stiffer boards provide for a more direct response, rather than effort being lost to flex. Some boards are designed to be flexible. Flexible boards are usually intended for lower speed riding. The flex makes the board ride smoother and be an overall more enjoyable board for lower speeds.

Longboarding also provides an alternative form of exercise and recreation that is less dangerous and generally more accessible to individuals of all ages and skill levels. However, users of longboards are limited to lower body exercise, in the form of propelling the longboard through pushing off the ground with the user's foot. Accordingly, there is a need in the art of longboarding for a device that allows user's to use their upper body strength to propel the longboard. Such device should also help direct and guide the longboard to aide in directing the user about a chosen topography.

SUMMARY OF THE INVENTION

This invention provides an alternative to steering and propelling a longboard skateboard via a user's leg(s). The invention teaches a three part-constructed power pole in the form of a telescoping pole having a first portion, a second portion, and a wheel assembly. Such telescoping pole is preferably spring loaded wherein a section of the second portion is placed within the first portion. Such wheel assembly includes a spinning wheel made of rubber or polymer that rotates perpendicular to the length of the rod. By applying a force axially aligned with the power pole, the user can create a friction point and have the telescoping pole act as a brake. Alternatively, the user can create a greater level of downward force such that the spring action will propel the longboard and thereby the user.

In a first embodiment of the invention, the power pole comprises a telescoping pole having a first portion, a second portion, and the wheel assembly. The first portion includes a first end, a corresponding second end and a first tubular shaft, where a first handle is positioned proximate the first end. The second portion includes a first end, a corresponding second end, and a second tubular shaft having a diameter less than the first tubular shaft. The first end of the second portion is positioned within the first portion and includes a first coiled spring which engages a first flange located along the second tubular shaft. A second handle may be positioned between the first end and second end of the first tubular shaft.

The wheel assembly is affixed to the second end of the second portion. Such wheel assembly includes a third tubular shaft having a diameter less than the second tubular shaft. Preferably a portion of the third tubular shaft is positioned within the second end of the second portion. A second coiled spring is placed over the third tubular shaft and engages the second end of the second portion through a second flange positioned along the third tubular shaft. Positioned at the distal end of the third tubular shaft is a spinning wheel made of rubber or polymer, which rotates perpendicular to the first, second and third tubular shafts. Such spinning wheel may include a set of ball bearings to aide in rotation.

In a second embodiment of the power pole, the invention is directed to a rod having a first portion and a wheel assembly. Such first portion again includes a first tubular shaft having both a first end and second end, where a first handle is located at the first end. An optional second handle may be positioned between the first and second end of the first tubular shaft. Positioned below the first tubular shaft is a wheel assembly, which includes a second tubular shaft having a diameter less than the first tubular shaft. Preferably a portion of the second tubular shaft is positioned within the first tubular shaft to ensure rigidity and stability.

Positioned outside the second tubular shaft is a first coil spring. The first coil spring engages the first tubular shaft and a flange located about the second tubular shaft. Positioned below the flange is a spinning wheel, preferably made of rubber or a polymer. Such spinning wheel rotates perpendicular to the first and second tubular shafts. Optionally, the spinning wheel may include a set of ball bearings to aide in rotation.

In a third embodiment, the power pole is comprised of a first portion and a wheel assembly. Here, the first portion includes a first end, a second end, and a tubular shaft. A first handle is positioned about the first end, while a second handle is positioned between the first and second end of the tubular shaft. Positioned proximate the second end of the tubular shaft is the wheel assembly, which features a spinning wheel perpendicular to the tubular shaft (without use of coiled spring), that may include use of one or more ball bearings.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Use of the Power Pole

Figure 1:
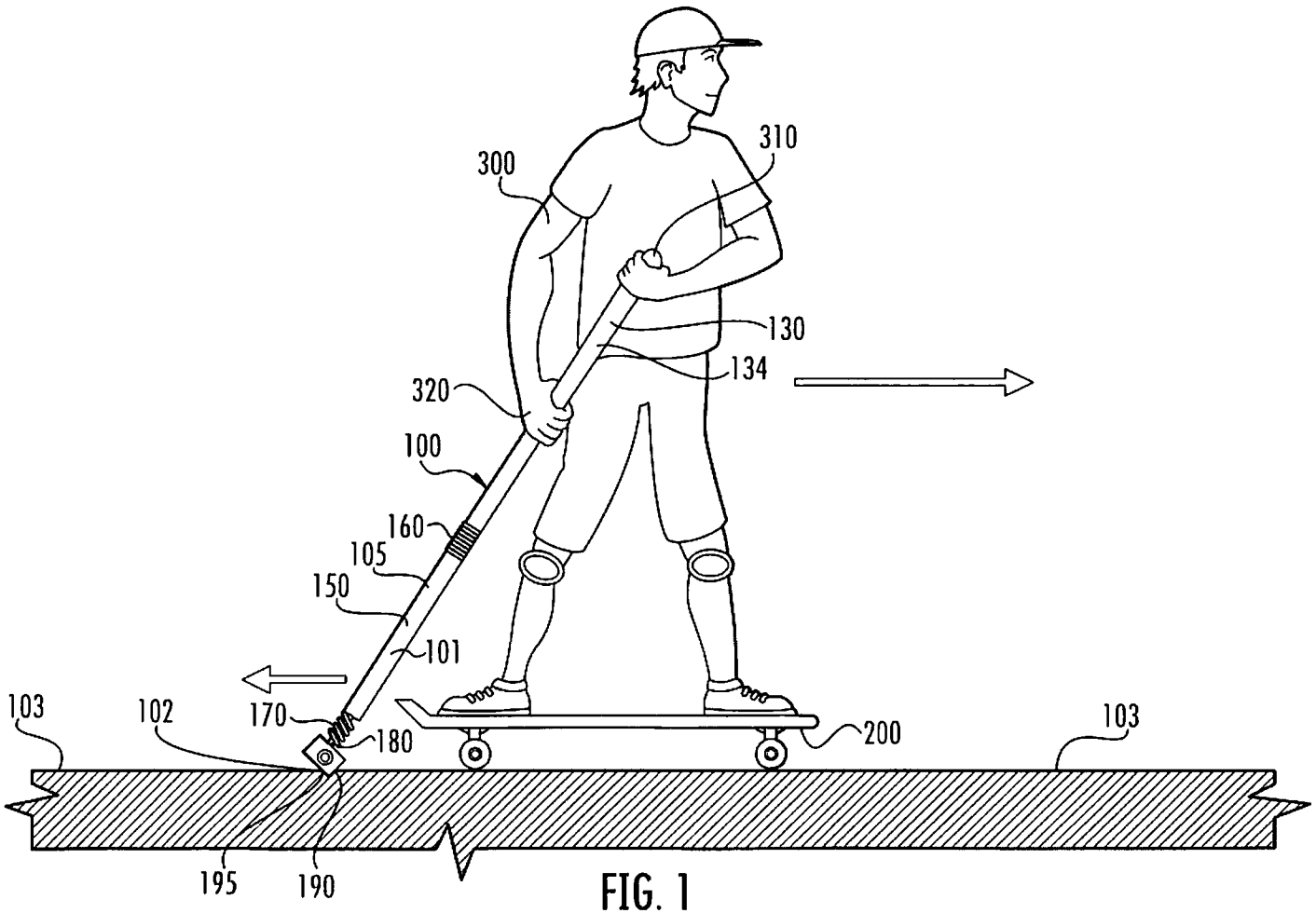
FIG. 1 is a front view of the power pole and how it is used by a user on a longboard.

FIG. 1 illustrates, by way of example, the manner of use of the power pole 100, which comprises a telescoping pole 105 of three part construction. In one embodiment, such telescoping pole 105 includes a first portion 130, a second portion 150 and a wheel assembly 170. Preferably, a portion of the second portion 150 is positioned within the first portion 130, while a section of the wheel assembly 170 is placed within the second portion to create a rigid and stable shaft. Such telescoping pole 105 is aided by placement of a first coil spring 160 between the first and section portions 130 and 150, as well as a second coil spring 180 located between the second portion 150 and the wheel assembly 170.

As shown in FIG. 1, the power pole 100 is held by a preferably user 300 while standing upright on a longboard 200. As shown, the user 300 places a first hand 310 on the first handle 110 of the power pole 100, while a second hand 320 is placed on the second handle 120. By exerting significant downward force which is axially aligned to the telescoping pole 105, both coiled springs 160 and 180 compress which compression may be used to propel the long board 200 (and accordingly the user 300) forward. By exerting a slight level of force axial to the power pole 100, the power pole 100 may be used to create enough friction to act as a brake.

The power pole 100 is also capable of directing the longboard 200 to allow the user to chart a desired course. By using both handles 110 and 120 to push the power pole 100 away from the user 300, the longboard 200 will move in the opposite direction. In addition, by pushing the power pole 100 toward (or behind) the user 300 the longboard 200 will move in an second (and again opposing) direction. Put another way, by forcing the power pole 100 to the left, the longboard 200 and user will go right—but changing the direction of the power pole 100 to the right, the longboard 200 and user 300 will go left.

The components 101 and assembly of the power pole 100, as described in greater detail below, also allows the power pole 100 to act as a brake for the longboard 200. By applying downward force on both handles 110 and 120, the power pole 100 will create a friction point 102 with the ground 103 such that it slows down the momentum of both the longboard 200 and consequently the user 300. By alleviating such downward force, the user 300 can control the momentum and speed of the longboard 200.

In short, the features and components 101 of the power pole 100 help not only propel the longboard 200, but also allow the user 300 to control the momentum, direction and overall speed throughout a ride—all without requiring the user 300 to change footing on the longboard 200.

Components of the Power Poll

Figure 2:
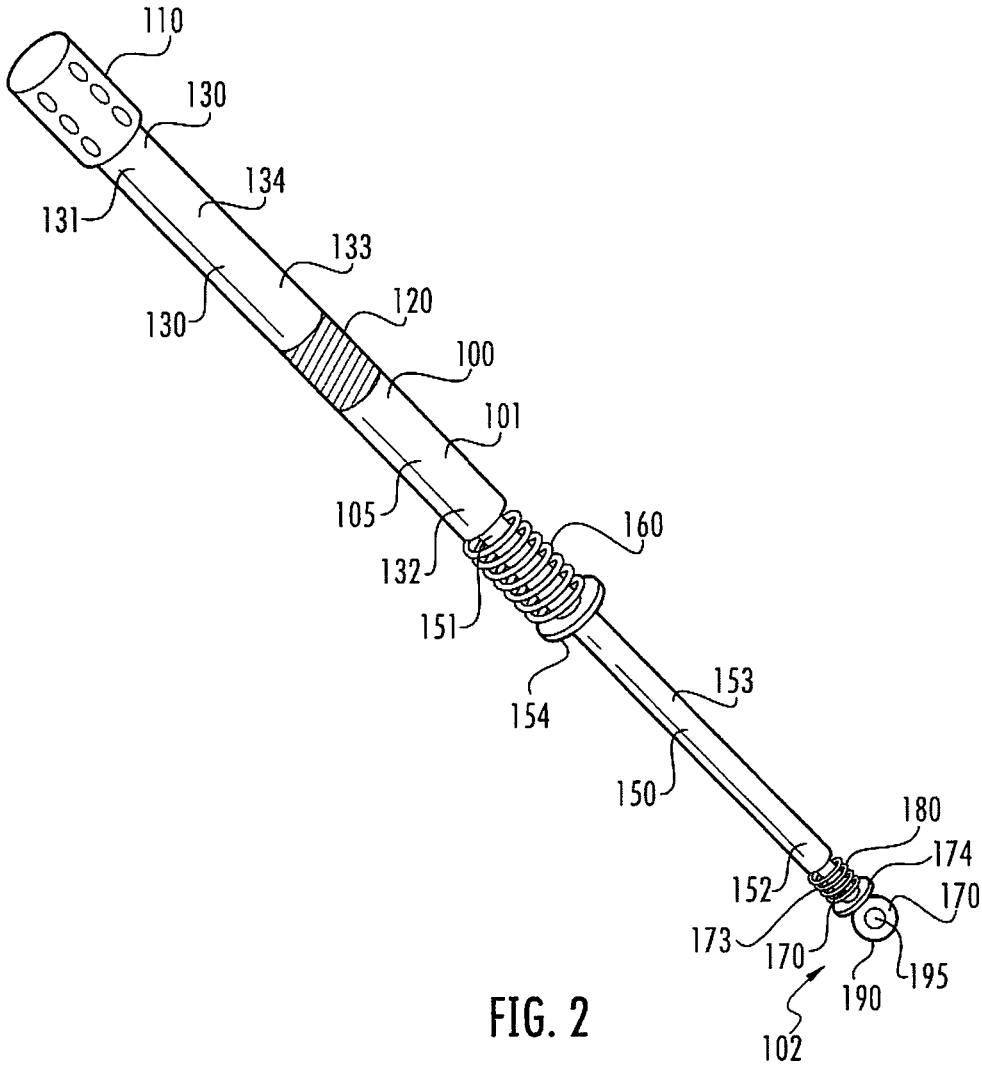
FIG. 2 is a perspective view of the power pole and its salient components.
Figure 3:
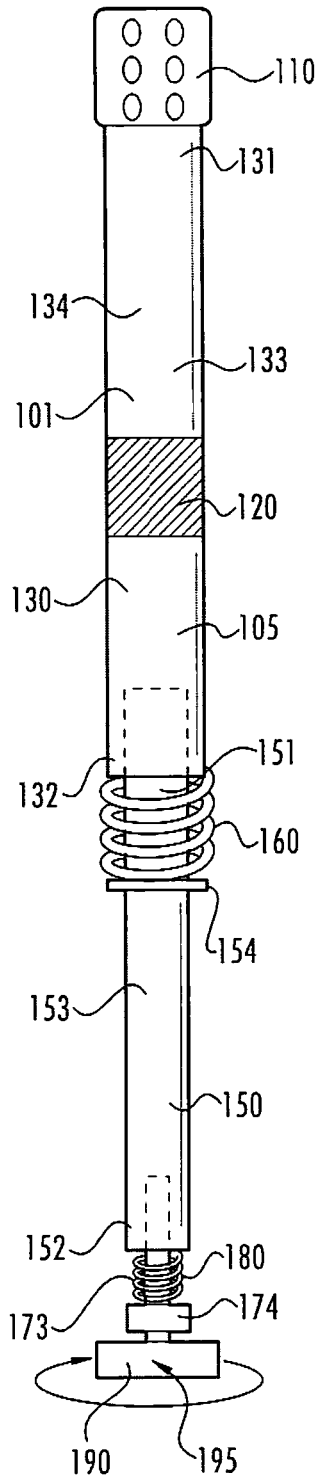
FIG. 3 is a front view of the power pole.

Both FIG. 2 and FIG. 3 illustrate, by way of example, the specific components 101 of the power pole 100 which is preferably made of a lightweight yet resilient metal or composite. First turning to FIG. 2, the power pole 100 may comprise a telescoping pole 105 having both a first portion 130 and a second portion 150. As shown, the first portion 130 is positioned above and on-top of the second portion 150. The first portion 130 also has a diameter that is larger than the second portion 150. Accordingly, the second portion 150 has a size and dimension that is sufficient to fit within the first portion 130.

As further shown in FIG. 2, the first portion 130 of the telescoping pole 105 has a first end 131, a corresponding second end 132, and a first tubular shaft 133. Such first end 131 is at the distal end farthest from the second portion 150, while the second end 132 is the portion of the first portion 130 which engages such second portion 150. Positioned proximate the first end 131, is a first handle 110. As shown, such first handle 110 can include a plurality of contact points 111 to aid in gripping the power pole 100.

A second handle 120 is located between the first end 131 and the second end 132 along the first tubular shaft 133.

Similar to the first handle 110, the second handle 120 contains a plurality of contact points 121 to help grip the first portion 130. The second handle 120 primarily functions to direct and move the power pole 100 to propel and direct the longboard 200 and the user 300. However, as shown in greater detail in FIG. 1, the first handle 110 primarily functions to hold and maintain the power pole 100 while using a longboard 200.

FIG. 2 further illustrates the salient components 101 of the second portion 150. As shown, the second portion 150 of the telescoping pole 105 has a first end 151, a corresponding second end 152, and a second tubular shaft 153. The first end 151 is engaged with the second end 132 of the first portion 130. A first coil spring 160 is positioned about the exterior of the second tubular shaft 153 proximate the first end 151. Preferably, the first coil spring 160 has a diameter that mirrors that of the first portion 130. As such, the first coil spring 160 may engage the second end 132 of the first portion 130, as well as a first circular flange 154 positioned along the tubular shaft 153.

When an axial force is placed onto the second portion 150, the first coil spring 160 will compress. Such compression then causes the first end 151 of the second portion 150 to be further inserted within the second end 132 of the first portion 130. The circular coil spring 160 shall revert to its normal position after removing such compression force, causing a portion of the first end 151 of the second portion 150 to eject from the first portion 130. There is always a sufficient section of the first end 151 of the second portion 150 that is located and secured within the first portion 130 to ensure that the telescoping pole 105 is axially rigid.

The second end 152 of the second portion 150 acts as a friction point 102 with the ground 103 though a wheel assembly 170 or other frictional engaging structure.

The Wheel Assembly

Figure 4:
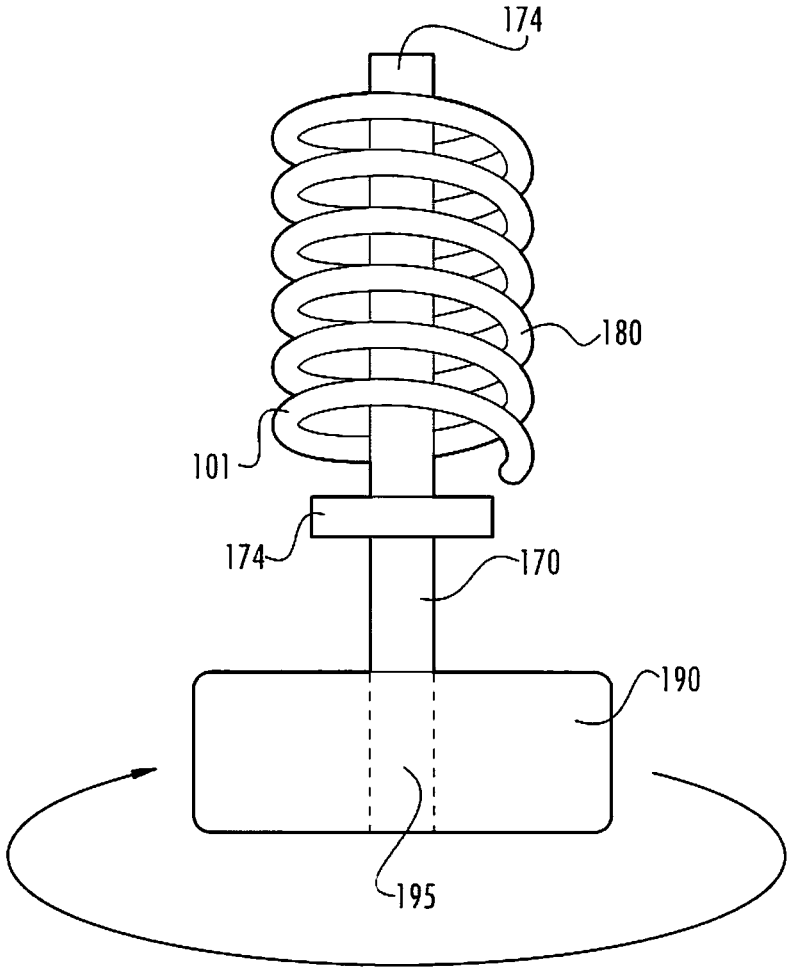
FIG. 4 is a front view of the bottom portion of the power pole.

As shown in greater detail in FIG. 3 and FIG. 4, the second end 152 of the second portion 150 includes a wheel assembly 170. As shown in FIG. 3, the wheel assembly 170 includes a third tubular shaft 173, as well as a second coil spring 180. The second coil spring 180 as a diameter that mirrors the diameter of the second tubular shaft 153. Moreover, the second coil spring 180 is inter-disposed between the second end 152 of the second portion 150 as well as a second circular flange 174.

As force is applied to the power pole 100, the second coil spring 180 compresses causing the third tubular shaft 173 to fall within the second portion 150. After such force is removed, the coil spring 180 shall return to its natural position and accordingly eject a portion of the third tubular shaft 173. A certain section of the third tubular shaft 173 is always maintained within the second portion 130 to ensure a sufficient amount of rigidity.

FIG. 4 illustrates the remaining portions of the wheel assembly 170 located below the second circular flange 174. As shown, the wheel assembly includes a circular wheel 190 that is positioned parallel to the second circular flange 174. Such spinning wheel 190 is affixed to the third tubular shaft 173 through a one or more bearings 195. These bearings 195 allow the spinning wheel 190 to freely rotate about the third tubular shaft 173. Preferably, the spinning wheel 190 is made of a hard rubber, akin and similar to a roller-skate wheel.

The positioning of the circular wheel 190 allows the power pole 100 to both brake as well as direct the longboard depending upon how the user 100 positioned the device on the ground 103. For example, should the user 300 opt to brake to slow down the longboard 200, a direct amount of force should be placed upon the power pole 100 to axially align the third tubular shaft 173 with the ground 103. By doing this, the spinning wheel 190 will no rotate and instead act as a friction point 102. In contrast, by resting the power pole 100 at an angle while the longboard 300 coasts about the ground 103, the spinning wheel 190 will freely rotate—allowing the user 200 to drag the telescoping pole 205 with limited friction or disruption to the ride.

Such positioning of the spinning wheel 190 allows the user 300 to employ both handles 110 and 120 to direct the longboard 200 through engaging the power pole 100 about the ground 103—by applying the right amount of friction to direct the longboard 200 to the user's 300 desired course.

Figure 5:
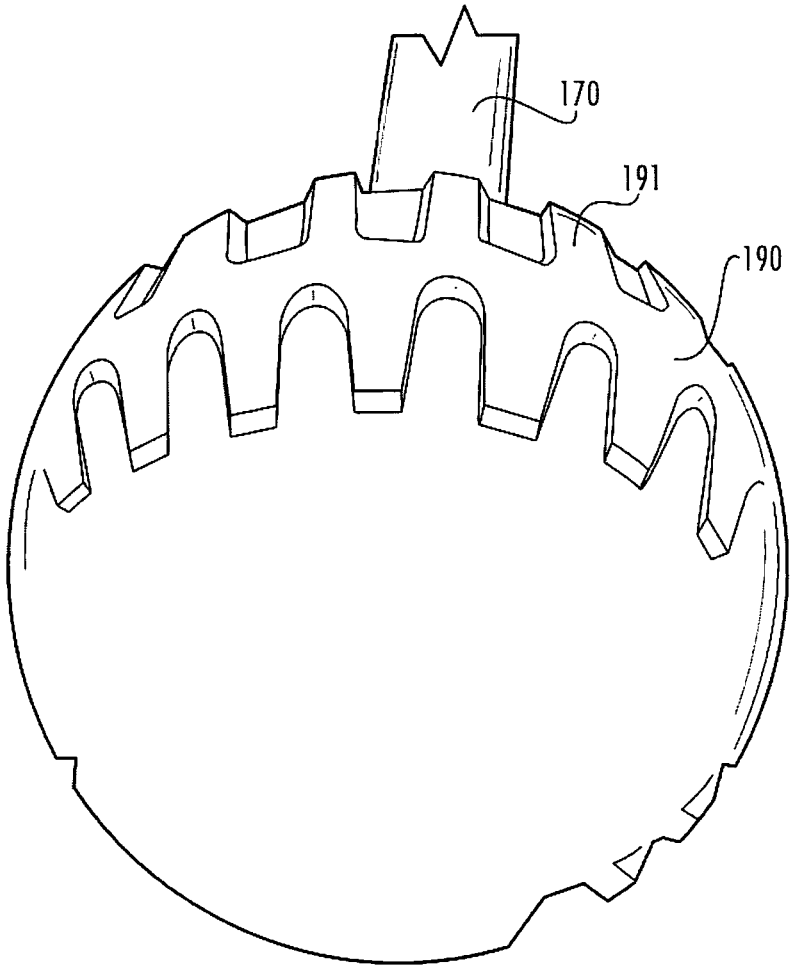
FIG. 5 is a perspective view of the spinning wheel.

FIG. 5 illustrates, by way of example, one preferred arrangement of the spinning wheel 190. The spinning wheel 190 can have a degree of tread 191 sufficient to create a friction point 102 on the ground 103 to help grip the telescoping pole 105. As illustrated, such tread 191 is preferably oscillating in orientation and arrangement. As shown in both FIG. 1 and FIG. 6 (described in greater detail below), such spinning wheel 190 can further include a diagonal cut sufficient to also create a proper fiction point 102.

Alternative Embodiment of the Telescoping Pole

Figure 6:
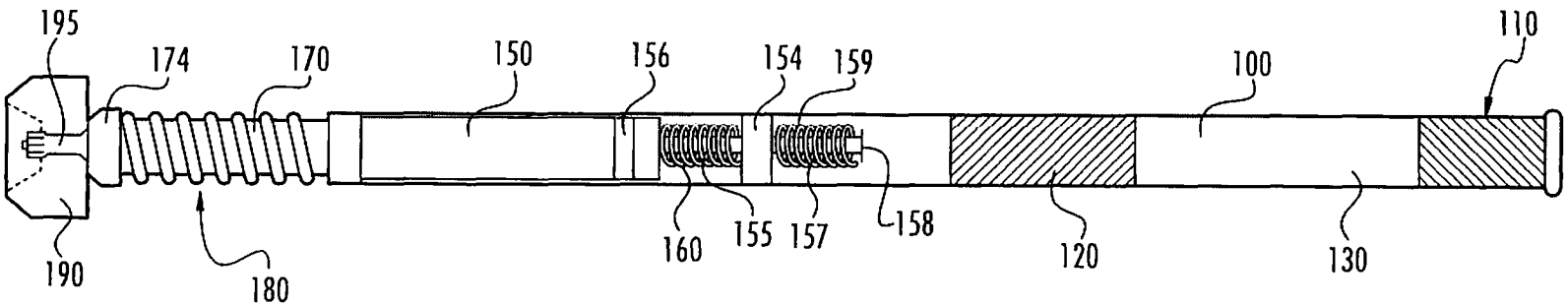
FIG. 6 is an alternative embodiment of the telescoping pole.

FIG. 6 illustrates, by way of example, an alternative embodiment for the telescoping pole 105. As shown, this alternative pole 105 includes a first portion 130 and second portion 150. The first portion 130 is essentially the same as the first embodiment, having a first handle 110 and corresponding second handle 120. However, the primary charge is in the second portion 150 and how it engages with the first portion 130. As shown, the first circular flange 154 is affixed near the second end 132 of the first tubular shaft 133. Here, the first circular flange 154 has an opening 159 of a sufficient size and orientation so as to receive an internal rod 155.

As further shown in FIG. 6, this internal rod 155 is affixed to an internal bushing 156 positioned and affixed to the second tubular shaft 153 of the second portion 150. Alternatively, the internal bushing 156 can communicate with the third tubular shaft 173, instead of the second tubular shaft 153. Positioned on the internal rod 155 is a second first coil spring 160. When force is applied to the telescoping rod 160, the internal, bushing 156 causes the first coil spring 160 to compress onto the first circular flange 154. Through this orientation, the entire first spring assembly is internal to the telescoping rod 105.

The second alternative shown and illustrated in FIG. 6 can also include a dampening spring 157 which is affixed to the internal rod 154. When such dampening spring 157 is employed, the internal rod 154 is elongated such that it extends beyond the opening 159. Positioned at the distal end of the internal rod 154 is a washer 158. By placing the depending spring 157 about the internal rod 154, this spring helps recoil and reposition the telescoping rod 150 into its normal position when any force is removed from the power pole 100 (i.e., there telescoping rod 105 is no longer on the ground 103).

Additional Alternative Embodiments

The invention is further directed to two alternative embodiments of the power pole 100. In a second embodiment, the telescoping pole 105 has just a two-part construction (as opposed to a three part construction) having both a first portion 130 and a wheel assembly 170. Such first portion 130 again includes a first tubular shaft 133 having both a first end 131 and second end 132, where a first handle 110 is located at the first end 131. An optional second handle 120 may be positioned between the first and second end (131 and 132) of the first tubular shaft 133. Positioned below the first tubular shaft 133 is a wheel assembly 170, which includes a second tubular shaft 173 having a diameter less than the first tubular shaft 133. Preferably a portion of the second tubular shaft 173 is positioned within the first tubular shaft 133 to ensure rigidity and stability.

Positioned outside the second tubular shaft 173 is a first coil spring 180. The first coil spring 180 engages the first tubular shaft 134 and a flange 174 located about the second tubular shaft 173. Positioned below the flange 174 is a spinning wheel 190, preferably made of rubber or a polymer. Such spinning wheel 190 rotates perpendicular to the first and second tubular shafts (133 and 173). Optionally, the spinning wheel 190 may include a set of ball bearings 195 to aide in rotation.

In a third embodiment, the power pole 100 is comprised of a first portion 130 and a wheel assembly 170 (without any use of a first or second coil spring). Here, the first portion 130 includes a first end 131, a second end 132, and a tubular shaft 133. A first handle 110 is positioned about the first end 131, while a second handle 120 is positioned between the first and second end (131 and 132) of the tubular shaft 133. Positioned proximate the second end of the tubular shaft 134 is the wheel assembly 170, which features a spinning wheel 190 perpendicular to the tubular shaft 134, that may include use of one or more ball bearings 195.

We claim:

1. A telescoping pole useful in guiding and directing a longboard skateboard, the telescoping pole comprising:

a first tubular shaft having a first end and a corresponding second end, wherein a first handle is located at the first end;

a wheel assembly is positioned proximate the second end of the first tubular shaft that includes a second shaft having diameter less than the first tubular shaft;

a first coil spring placed over the second shaft that engages the second end of the first tubular portion; and an internal dampening spring assembly positioned within the first tubular shaft, the internal dampening spring assembly including a first flange affixed to the first tubular shaft having an opening, an internal rod of sufficient size and dimension so as to slide within the opening of the first flange, an internal bushing affixed to one end of the internal rod which is in communication with the second tubular shaft of the wheel assembly, a stopper positioned at a second end of the internal rod and positioned within the first tubular shaft, and a dampening spring positioned on the internal rod within the first tubular shaft between the first circular flange and the stopper.

2. The telescoping pole of claim 1, wherein a wheel, rotatable about a longitudinal axis of the telescoping pole, is position at the distal end of the wheel assembly.

3. The telescoping pole of claim 2, wherein the wheel includes one or more bearings.

4. The telescoping pole of claim 3, wherein a second handle is positioned on the first tubular shaft between the first end and the second end.

* * * * *